US010159334B1

(12) United States Patent
Wang et al.

(10) Patent No.: US 10,159,334 B1
(45) Date of Patent: Dec. 25, 2018

(54) COLLAPSIBLE PICNIC TABLE

(71) Applicant: Zhuhai Shichang Metals Ltd., Zhuhai (CN)

(72) Inventors: Che-Jen Wang, Zhuhai (CN); Guogong Tan, Zhuhai (CN)

(73) Assignee: Zhuhai Shichang Metals Ltd. (CN)

( * ) Notice: Subject to any disclaimer, the term of this patent is extended or adjusted under 35 U.S.C. 154(b) by 0 days.

(21) Appl. No.: 15/891,682

(22) Filed: Feb. 8, 2018

(51) Int. Cl.

| | |
|---|---|
| ***A47B 3/14*** | (2006.01) |
| ***A47C 3/40*** | (2006.01) |
| ***A47B 3/02*** | (2006.01) |
| ***A47B 3/091*** | (2006.01) |

(52) U.S. Cl.
CPC ..... *A47B 3/14* (2013.01); *A47B 3/02* (2013.01); *A47B 3/0912* (2013.01); *A47C 3/40* (2013.01); *A47B 2003/025* (2013.01); *A47B 2003/145* (2013.01)

(58) Field of Classification Search
CPC ..... A47B 83/02; A47B 3/14; A47B 3/0912; A47B 3/02; A47B 2003/145; A47B 2003/025
USPC ..... 297/158.4
See application file for complete search history.

(56) References Cited

U.S. PATENT DOCUMENTS

| | | | | |
|---|---|---|---|---|
| 3,276,815 A * | 10/1966 | Cardy | A47B 3/14 108/48 |
| 3,574,393 A * | 4/1971 | Hughes | A47B 3/14 108/35 |
| 6,347,831 B1 * | 2/2002 | Nye | A47B 3/14 297/118 |
| 7,735,915 B2 * | 6/2010 | Nye | A47B 37/04 108/132 |
| 2004/0070235 A1 * | 4/2004 | Gregory | A47B 3/14 297/158.4 |

* cited by examiner

*Primary Examiner* — Milton Nelson, Jr.
(74) *Attorney, Agent, or Firm* — Luedeka Neely Group, PC

(57) ABSTRACT

A collapsible picnic table having a tabletop and table supports that extend downward from the bottom surface of the tabletop in a use position and are adjacent the bottom surface of the tabletop in a stored position. Seat supports, pivotally attached to a first seat, rotate simultaneously with and in the same direction as the table supports. In a use position, the seat supports extend downwards from the first seat and are adjacent the bottom surface of the first seat and extend outwards from the table supports in a first stored position. The seat supports are pivotally attached to the table supports and rotate orthogonally to the rotation of the table supports from the first stored position to a second stored position, where the seat supports are adjacent the bottom surface of the first seat and are adjacent the bottom of the tabletop and table supports.

14 Claims, 5 Drawing Sheets

COLLAPSIBLE PICNIC TABLE

FIELD

This invention relates to the field of furniture. More particularly, this invention relates to a picnic table having table supports and seat supports that may be collapsed and then folded against the tabletop.

BACKGROUND

Banquet and utility tables having collapsible legs are well known. Conventional collapsible tables typically have a use configuration and a storage configuration. In the use configuration, a pair of collapsible legs is folded downwards from the tabletop and are placed onto a ground surface to support the tabletop in a raised position. In the storage configuration, the collapsible legs are folded underneath the tabletop. Typically, separate chairs are used in connection with collapsible tables to provide seating for users. On the other hand, bench seating is provided with picnic tables and separate chairs are not required. Conventional collapsible picnic tables function in a similar manner to collapsible banquet tables and, in the storage position, the collapsible legs are folded beneath the tabletop. Having seating already provided by a picnic table is a convenience, but the seating is not typically not folded beneath the table in the stored position. For this reason, collapsible picnic tables are typically much larger and more difficult to transport and store than collapsible banquet tables, even in a storage configuration.

What is needed, therefore, is a collapsible picnic table that may be folded to a storage configuration having a reduced footprint that is similar in size to collapsible banquet tables and is convenient for storage and transport.

SUMMARY

The above and other needs are met by a collapsible picnic table comprising a tabletop and first and second table supports that are operable to move between a use position and a storage position. The first and second table supports each have table attachment portions and table foot portions. The table attachment portions are pivotally attached to the bottom surface of the tabletop and configured rotate in a first rotational direction between the use position and storage position. In the use position, the first and second table supports extend downward from the bottom surface of the tabletop. In the storage position, the first and second table supports are disposed adjacent the bottom surface of the tabletop. The table foot portions are spaced apart from the table attachment portions and are operable to contact a ground surface when the first and second table supports are in the use position. The table foot portions disposed adjacent the bottom surface of the tabletop when the first and second table supports are in the storage position.

The table includes a first seat and a pair of spaced apart first seat supports that are operable to move between the use position, an intermediate position, and the storage position. Each first seat support includes first seat attachment portions and first seat foot portions. The first seat attachment portions are pivotally attached to the bottom surface of the first seat and are configured to rotate in conjunction with the table attachment portions in the first rotational direction between the use position in which the first seat supports extend downward from the bottom surface of the first seat, and the intermediate position in which the first seat supports are disposed adjacent the bottom surface of the first seat. The first seat foot portions are spaced apart from the first seat attachment portions and are operable to contact the ground surface when the first seat supports are in the use position, and are disposed adjacent the bottom surface of the first seat when the first seat supports are in the intermediate position.

Each first seat foot portion is pivotally attached to a corresponding one of the table foot portions, and is configured to rotate by 180 degrees in a second rotational direction that is orthogonal to the first rotational direction. Each first seat foot portion is operable to rotate from the intermediate position, in which the first seat attachment portions are spaced apart from the table attachment portions, to the storage position, in which the first seat attachment portions are disposed adjacent the table attachment portions and the bottom surface of the first seat faces the bottom surface of the tabletop.

In some embodiments, the collapsible picnic table includes a second seat and a pair of second seat supports that operate in substantially the same manner as the first seat and first seat supports.

In some embodiments, each first seat support comprises a length-adjustable shaft for raising and lowering the first seat, and a latch for selectively securing the shaft in either a first or second vertical position.

In some embodiments, the length adjustable shaft comprises a first shaft member telescopically positioned within a second shaft member, and the latch comprises a spring-biased detent disposed on the first shaft member configured to selectively engage each one of at least two openings disposed in the second shaft member.

In some embodiments, the top surface of the first seat is substantially co-planar with the top surface of the tabletop when the shaft is secured in the first vertical position.

In some embodiments, each of the first and second table supports is X-shaped.

In some embodiments, the table includes opposing first and second side rails that are attached to the bottom surface of the tabletop, wherein each of the first and second table supports is pivotally attached between the first and second side rails.

In some embodiments, the table includes end supports that are fixedly attached between the first and second side rails and disposed proximate opposing ends of the tabletop. The table attachment portions of each of the first and second table supports are pivotally attached to a corresponding one of the end supports.

In some embodiments, the table includes a center support that is fixedly attached between and perpendicular to the first and second side rails.

In some embodiments, the center support includes first and second center support members. The first center support member has a first outer end that is attached to the first side rail at a position that is laterally offset from a center of the tabletop in a third direction. The second center support member has a second outer end that is attached to the second side rail at a position that is laterally offset from the center of the tabletop in a fourth direction that is opposite the third direction. The first center support member includes a first inner end that is joined to the second center support member at a position that is laterally offset in the fourth direction from the center of the tabletop. The second center support includes a second inner end that is joined to the first center support member at a position that is laterally offset in the third direction from the center of the tabletop. In this configuration, an opening is formed between the first and second inner ends of the first and second center support members.

In some embodiments, an aperture is provided in the tabletop that aligns with the opening formed by the first and second inner ends of the first and second center support members.

In some embodiments, the table includes a first collapsible support arm that pivotally connects the first center support member to the first table support, and a second collapsible support arm that pivotally connects the second center support member to the second table support.

In some embodiments, the table includes pivotal tabletop connections, pivotal seat connections, and pivotal foot connections. The pivotal tabletop connections rotatably connect the table attachment portions of the first and second table supports to the bottom surface of the tabletop. The pivotal seat connections connect the first seat attachment portions of the first seat supports to the bottom surface of the first seat, wherein the pivotal seat connections are configured to rotate in the first rotational direction in conjunction with the pivotal tabletop connections. The pivotal foot connections connect the table foot portions of the first and second table supports to the first seat foot portions of the first seat supports. The pivotal foot connections are configured to rotate in the second rotational direction.

BRIEF DESCRIPTION OF THE DRAWINGS

Other embodiments of the invention will become apparent by reference to the detailed description in conjunction with the figures, wherein elements are not to scale so as to more clearly show the details, wherein like reference numbers indicate like elements throughout the several views, and wherein.

DETAILED DESCRIPTION

Figure 2:
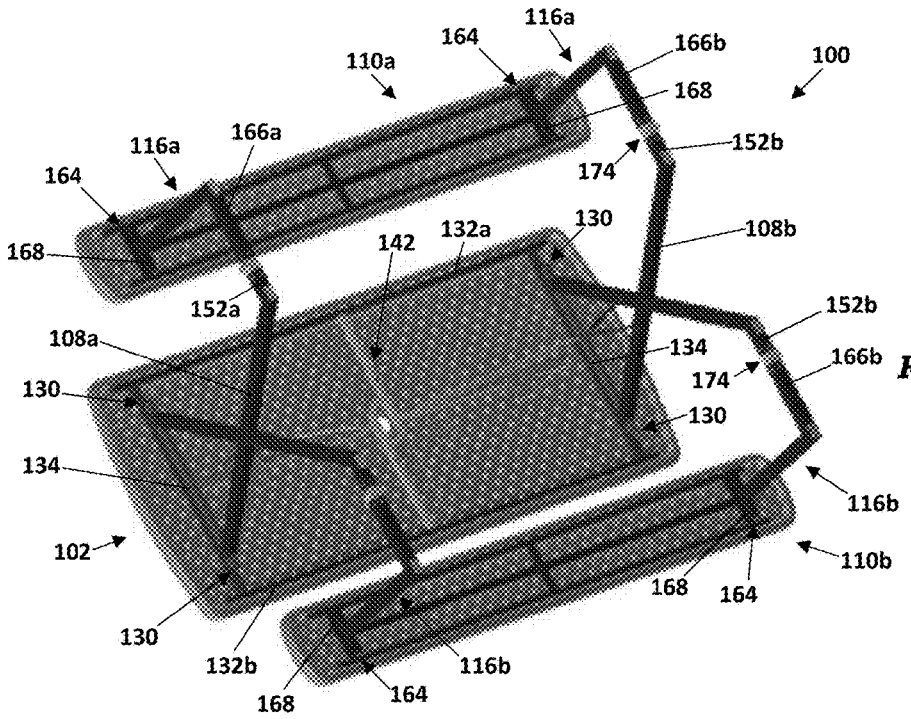
FIG. 2 depicts a bottom perspective view of the collapsible picnic table in the use position according to a preferred embodiment.
Figure 3:
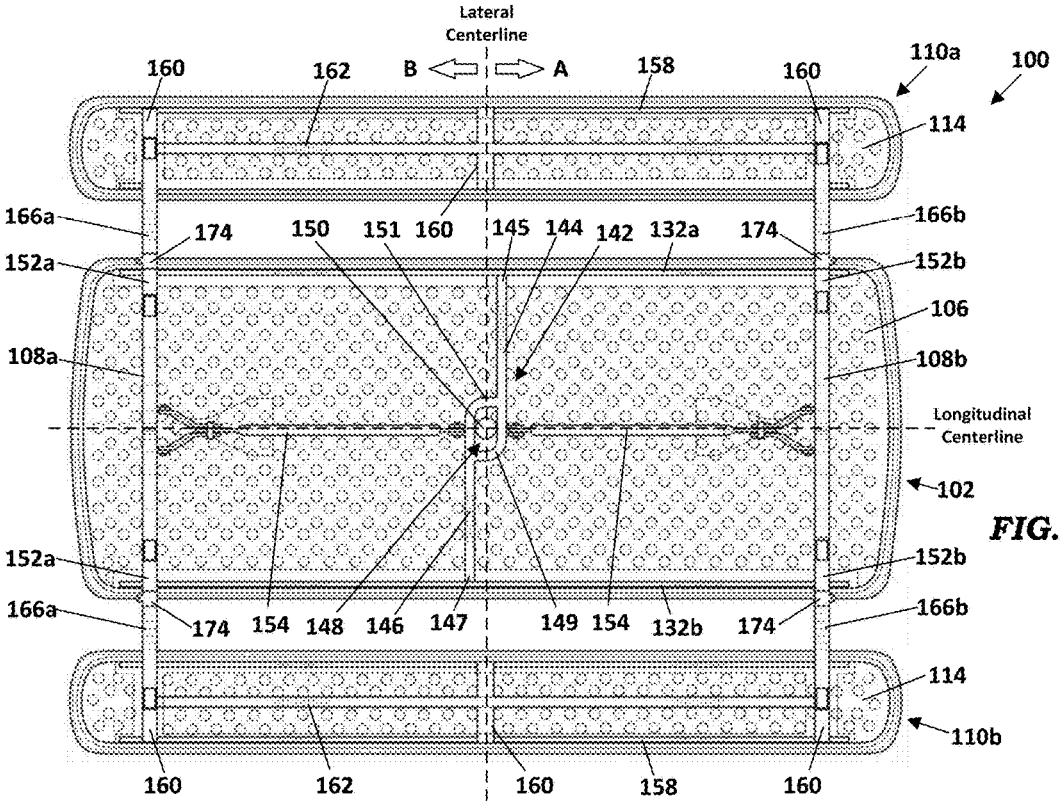
FIG. 3 depicts a bottom plan view of the collapsible picnic table in the use position according to a preferred embodiment.

As shown in the figures, a preferred embodiment of a collapsible picnic table 100 includes a tabletop 102 having a top surface 104 and a bottom surface 106. Preferably, the tabletop 102 is formed from blow-molded plastic. As shown in FIGS. 2 and 3, opposing first and second side rails 132*a*-132*b* are attached to the bottom surface 106, and opposing end support rails 134 are fixedly attached to the bottom surface 106 between the first and second side rails 132*a*-132*b*. The end support rails 134, which are disposed proximate the opposing ends of the tabletop 102, provide further rigidity to the tabletop 102.

A center support 142, which is fixedly attached between the first and second side rails 132*a*-132*b*, includes a first center support member 144 having a first outer end 145 that is attached to the first side rail 132*a* at a position that is laterally offset from a lateral centerline of the tabletop 102 in the direction indicated by the arrow A (also referred to herein as the third direction) as shown in FIG. 3. The center support 142 includes a second center support member 146 having a second outer end 147 that is attached to the second side rail 132*b* at a position that is laterally offset from the lateral centerline of the tabletop 102 in the direction indicated by the arrow B in FIG. 3 (also referred to herein as the fourth direction). The first center support member 144 includes a first inner end 149 that extends in the direction indicated by the arrow B beyond the longitudinal center line of the tabletop 102 and is attached to the second center support member 146. The second center support member 146 includes a second inner end 151 that extends in the direction indicated by the arrow A beyond the longitudinal center line of the tabletop 102 and is attached to the first center support member 144. As shown in FIG. 3, these connections of each inner end 147, 149 to the opposing center support member 144, 146 form an opening 148 in the center support 142 that is aligned with a corresponding aperture 150 in the center of the tabletop 102, through which an accessory (e.g., an umbrella) can extend.

Figure 4:
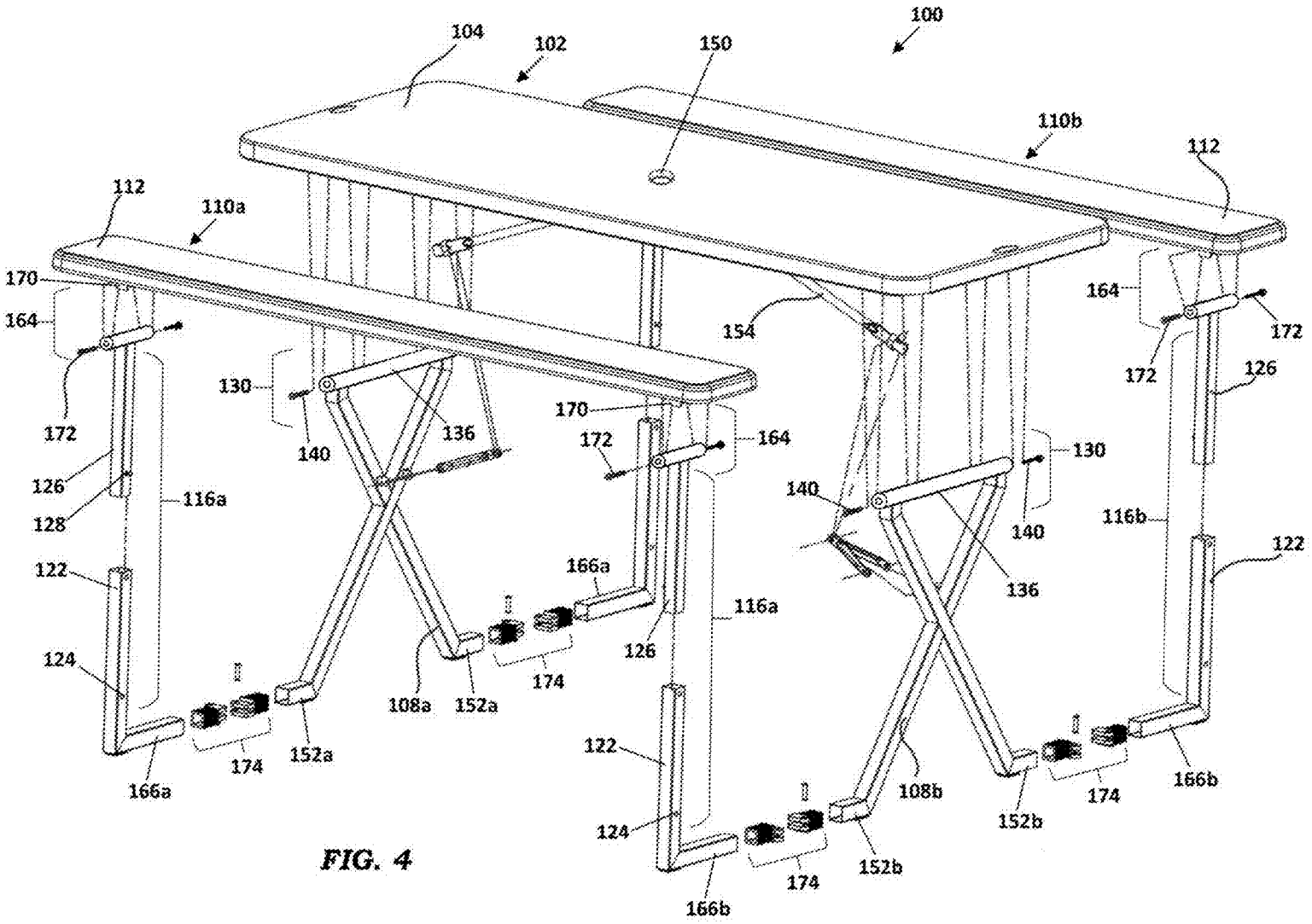
FIG. 4 depicts an exploded top perspective view of the collapsible picnic table according to a preferred embodiment.

With reference to FIGS. 2 and 4, X-shaped first and second table supports 108*a*, 108*b* are pivotally attached to the bottom surface 106 of the tabletop 102 via pivotal tabletop connections 130. The connections 130 allow the first and second table supports 108*a*-108*b* to move between the use position and the storage position. In the use position, the first and second table supports 108 extend outward from the bottom surface 106 of the tabletop 102, and table foot portions 152*a*-152*b* of the first and second table supports 108*a*-108*b* rest on a ground surface. In the storage position, the first and second table supports 108*a*-108*b* are collapsed inward to be disposed adjacent the bottom surface 106 of the tabletop 102 to make storage and transport easier.

Figure 8A:
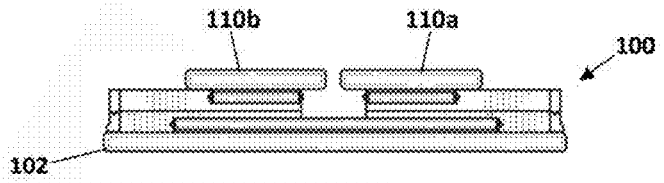
FIG. 8A depicts an end elevation view of the collapsible picnic table in the storage position according to a preferred embodiment.
Figure 8B:
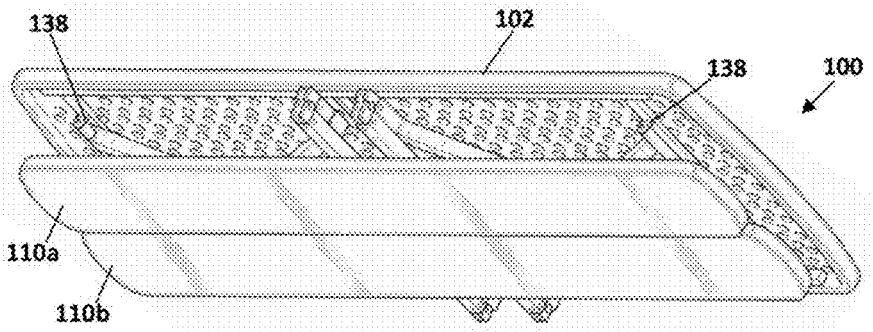
FIG. 8B depicts a bottom perspective view of the collapsible picnic table in the storage position according to a preferred embodiment.
Figure 8C:
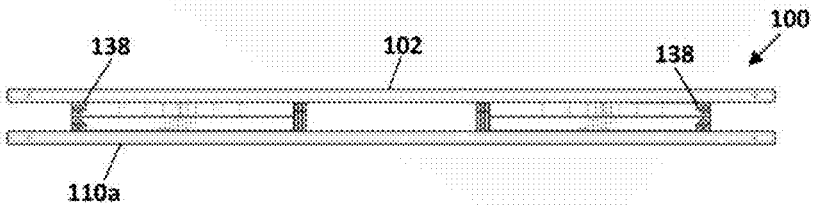
FIG. 8C depicts a side elevation view of the collapsible picnic table in the storage position according to a preferred embodiment.
Figure 8D:
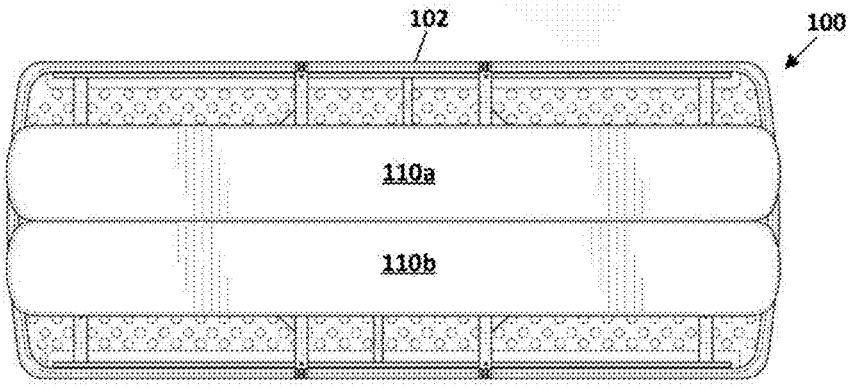
FIG. 8D depicts a bottom plan view of the collapsible picnic table in the storage position according to a preferred embodiment.

In preferred embodiments, the pivotal tabletop connections 130 pivotally connect the first and second table supports 108*a*-108*b* to the end support rails 134 between the first and second side rails 132*a*-132*b*. In one embodiment, a top bar 136 extends between the upper ends of each of the first and second table supports 108*a*-108*b*, which bar 136 is rotatably attached between a pair of tabs 138 (see FIGS. 5, 8B and 8C) that extend downward from the ends of each end support rail 134. Fastener pins 140 pass through openings in the tabs 138 and are secured in corresponding upper mounting openings formed at either end of the top bar 136.

Figure 5:
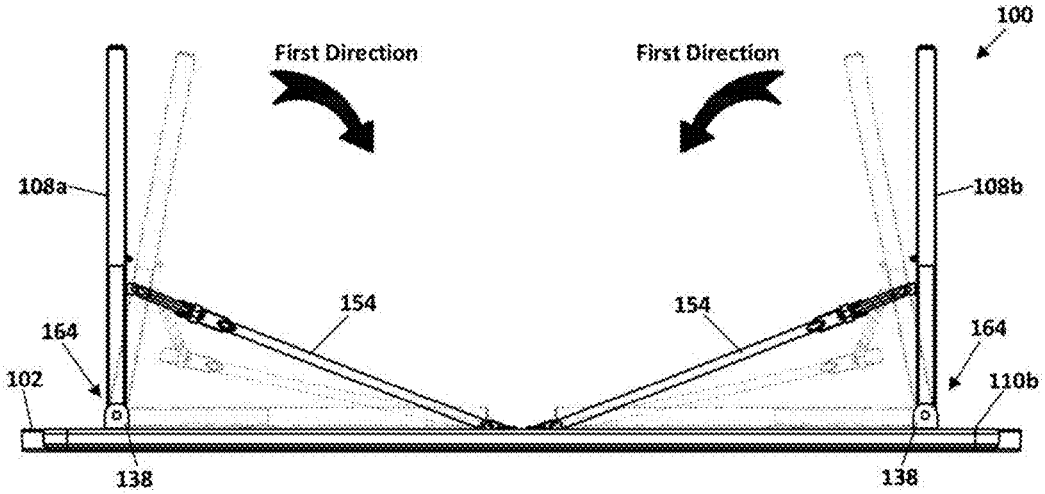
FIG. 5 depicts a side elevation view of the collapsible picnic table showing a first rotational direction of movement of table supports and seat supports toward a collapsed position according to a preferred embodiment.

With reference to FIGS. 3 and 5, the table 100 includes a pair of collapsible articulated support brackets 154 that securely hold the first and second table supports 108*a*-108*b* in the use position, and prevent the first and second table supports 108*a*-108*b* from collapsing inward toward the storage position. The structure and functionality of the articulated support brackets 154 are well known in the art and further discussion is not necessary.

The table 100 includes first and second seats 110*a* and 110*b*, located on opposing sides of the tabletop 102, each having a top surface 112 and a bottom surface 114. In a preferred embodiment, the first and second seats 110*a*-110*b* are formed from blow-molded plastic. As shown in FIG. 3, opposing side rails 158 are attached to the bottom surface 114 of each of the first and second seats 110*a*, 110*b*. Braces 160 are fixedly attached between the side rails 158 near each end of the first and second seats 110*a*-110*b* to enhance rigidity.

In some embodiments, a center rail 162 is positioned between and in parallel with the side rails 158. The center rail 162 is fixedly attached to the braces 160 to provide further rigidity to the first and second seats 110*a*-110*b*.

With reference to FIGS. 2, 4, and 5, first seat supports 116*a* are pivotally attached to the bottom surface 114 of the first seat 110*a* via pivotal seat connections 164 that allow the first seat supports 116*a* to move between the use position and the storage position. Similarly, second seat supports 116*b* are pivotally attached to the bottom surface 114 of the second seat 110*b* via pivotal seat connections 164 that allow the second seat supports 116*b* to move between the use position and the storage position. In the use position, the first and second seat supports 116*a*-116*b* extend outward from the bottom surfaces 114 of the first and second seats 110*a*-110*b*, and first and second seat foot portions 166*a* and 166*b* of the first and second seat supports 116*a*-116*b* rest on a ground surface. In the storage position, the first and second seat supports 116*a*-116*b* are collapsed inward to positions adjacent the bottom surface 114 of the corresponding first and second seats 110*a*-110*b*.

In a preferred embodiment, the first and second seat supports 116*a*-116*b* are pivotally attached to end braces 160 on the bottoms of the first and second seats 110*a*-110*b* via the pivotal seat connections 164. In one embodiment, a top bar 168 is disposed at a top end of each of the first and second seat supports 116*a*-116*b*, which is rotatably attached between a pair of tabs 170 that extend downward from the end braces 160. Fastener rods 172 pass through openings in the tabs 170 and are secured in corresponding openings formed at either end of the top bars 168. As discussed in more detail hereinafter, the first and second seat supports 116*a*-116*b* and the first and second table supports 108*a*-108*b* are joined together such that they move simultaneously and in the same direction from the use position to the storage position, and vice versa.

Figure 1A:
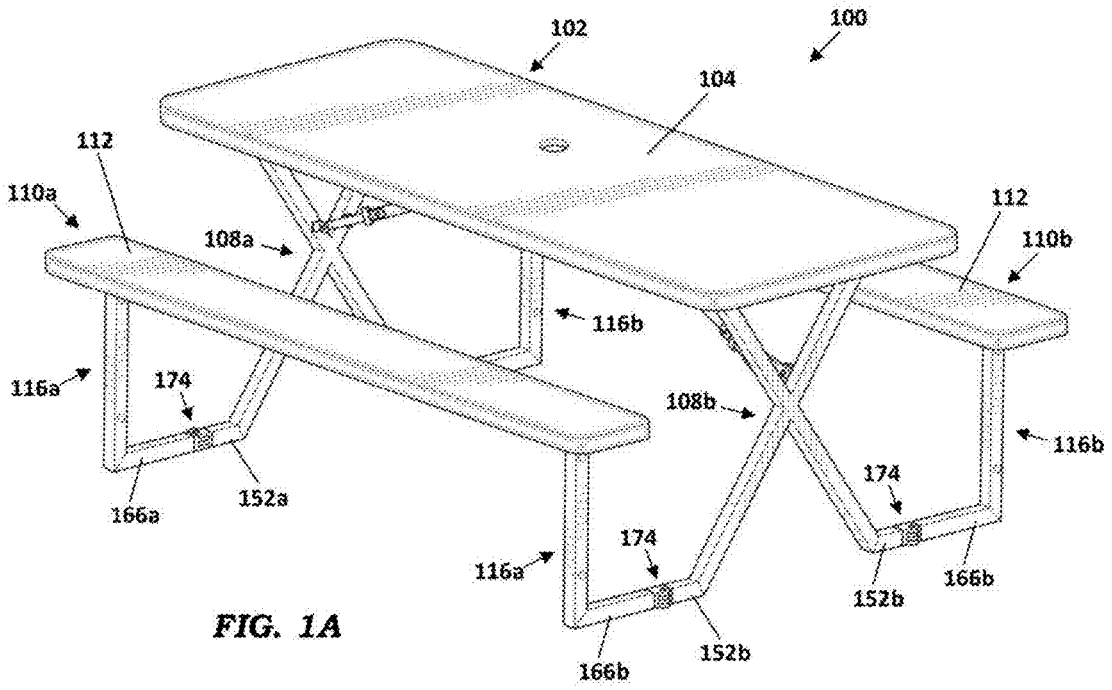
FIG. 1A depicts a top perspective view of a collapsible picnic table in a use position with seats positioned at a seating height according to a preferred embodiment.
Figure 1B:
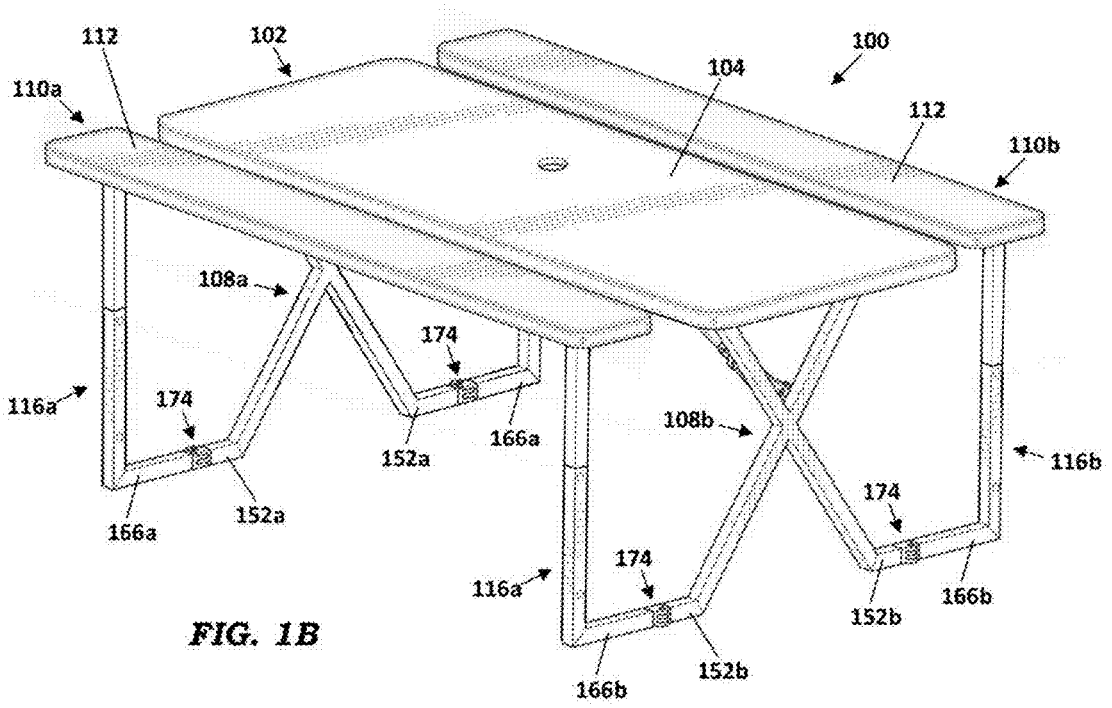
FIG. 1B depicts a top perspective view of the collapsible picnic table with the seats positioned at tabletop height according to a preferred embodiment.

As shown in FIGS. 1A and 1B, the first and second seat supports 116*a*-116*b* are operable to raise and lower the seats 110*a*-110*b* between a lower position and an upper position. In the lower position, the top surfaces 112 of the seats 110*a*-110*b* are vertically below the top surface 104 of the tabletop 102, so that the tabletop 102 is at a comfortable height for users seated on the seats 110*a*-110*b*. In the upper position, the top surfaces 112 of the seats 110*a*-110*b* are substantially co-planar with the top surface 104 of the tabletop 102. In a preferred embodiment, the first and second seat supports 116*a*-116*b* each include an length-adjustable structure comprising an upper portion 126 that telescopically slides within a lower portion 122. The lower portion 122 preferably has two or more openings 124 spaced along its length that are operable to selectively receive a spring-biased projection 128 in the upper portion 126. The projection 128 functions as a locking mechanism that automatically secures the seat 110*a*-110*b* at the lower or upper position.

Figure 6:
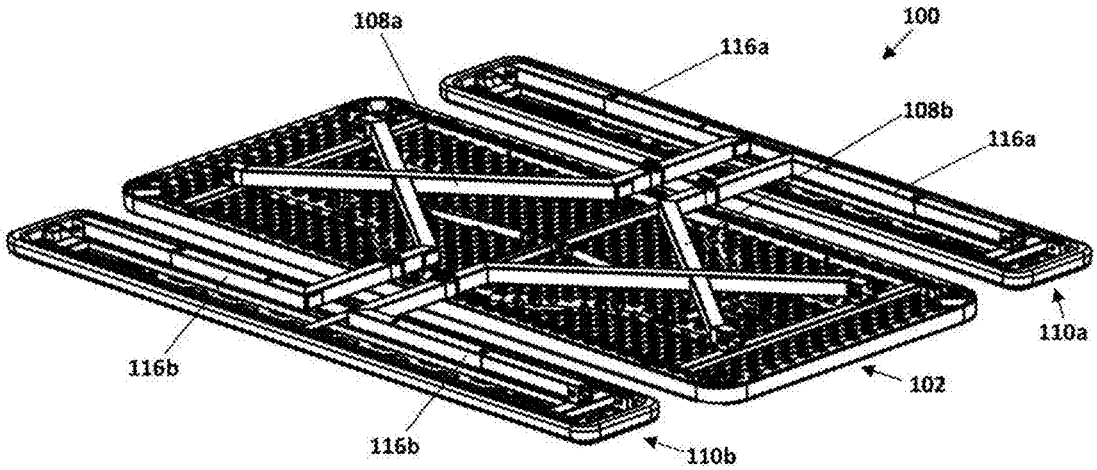
FIG. 6 depicts a bottom perspective view of the collapsible picnic table with table supports and seat supports collapsed to an intermediate position according to a preferred embodiment.
Figure 7:
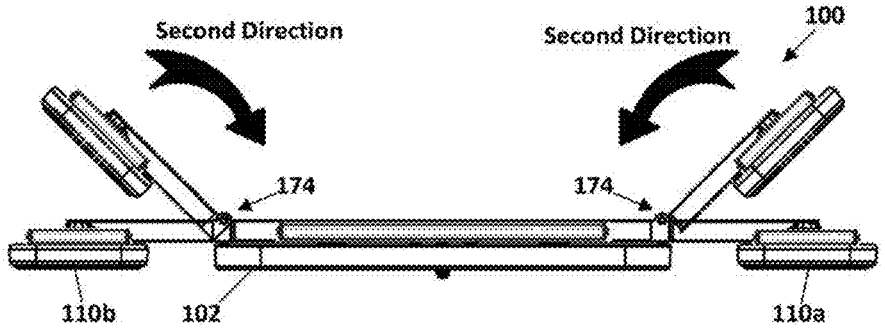
FIG. 7 depicts an end elevation view of the collapsible picnic table showing a second rotational direction of movement of the seat supports toward a storage position according to a preferred embodiment.

As discussed above, the table 100 has a use position (FIG. 1A) in which the tabletop 102 and seats 110 are positioned for use, and a storage position (FIG. 12) in which the overall footprint of the table is reduced to make it better suited for transport and storage. As shown in FIGS. 5-7, several steps are required to transition the table 100 from the use position to the storage position. First, the seats 110*a*-110*b* are raised to the upper position, as shown in FIG. 1B. As shown in FIG. 5, the braces 154 are then unlocked and moved inward so that the first and second table supports 108*a*-108*b* and first and second seat supports 116*a*-116*b* can be simultaneously moved in a first direction as indicated by the arrows A.

As shown in FIG. 6, after the first and second table supports 108*a*-108*b* are fully collapsed, they are disposed adjacent the bottom surface 106 of the tabletop 102. At this point, the first and second seat supports 116*a*-116*b* are in an intermediate position in which the first and second seat supports 116*a*-116*b* are disposed adjacent the bottom surfaces 114 of the seats 110*a*-110*b*. In the preferred embodiment, the first and second seat supports 116*a*-116*b* are pivotally attached to the table foot portions 166*a*-166*b* of the first and second table supports 108*a*-108*b* via pivotal foot connections 174. In contrast to the pivotal tabletop connections 130 and the pivotal seat connections 164 that rotate in the first rotational direction as indicated by the arrows in FIG. 5, the pivotal foot connections 174 rotate in a second rotational direction that, as indicated by the arrows in FIG. 7, is orthogonal to the first rotational direction. Thus, the pivotal foot connections 174 rotate orthogonally to the rotation of the pivotal tabletop connections 130 and the pivotal seat connections 164. As shown in FIG. 7, the pivotal foot connections 174 allow the first and second seats 110*a*-110*b* and the first and second seat supports 116*a*-116*b* to collapse inward from opposing sides of the table 100 toward the center of the tabletop 102 into the storage position, which is depicted in FIGS. 8A-8D. In the storage position, the first and second seat supports 116*a*-116*b* are disposed adjacent the first and second table supports 108*a*-108*b*, and the first and second seats 110*a*-110*b* are disposed within the footprint of the bottom surface 106 of the tabletop 102. This functionality significantly reduces the overall footprint of the table 100 to simplify transport and storage.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A collapsible picnic table comprising:

a tabletop having a top surface and a bottom surface;

first and second table supports that are operable to move between a use position and a storage position, the first and second table supports each having:

table attachment portions that are pivotally attached to the bottom surface of the tabletop and configured to rotate in a first rotational direction between the use position, in which the first and second table supports extend downward from the bottom surface of the tabletop, and the storage position, in which the first and second table supports are disposed adjacent the bottom surface of the tabletop; and table foot portions spaced apart from the table attachment portions, the table foot portions operable to contact a ground surface when the first and second table supports are in the use position, the table foot portions disposed adjacent the bottom surface of the tabletop when the first and second table supports are in the storage position;

a first seat having a top surface and a bottom surface; and a pair of spaced apart first seat supports that are operable to move between the use position, an intermediate position, and the storage position, each first seat support having:

first seat attachment portions that are pivotally attached to the bottom surface of the first seat and configured to rotate in conjunction with the table attachment portions in the first rotational direction between the use position in which the first seat supports extend downward from the bottom surface of the first seat, and the intermediate position in which the first seat supports are disposed adjacent the bottom surface of the first seat; and first seat foot portions spaced apart from the first seat attachment portions, the first seat foot portions operable to contact the ground surface when the first seat supports are in the use position, the first seat foot portions disposed adjacent the bottom surface of the first seat when the first seat supports are in the intermediate position;

wherein each first seat foot portion is pivotally attached to a corresponding one of the table foot portions, and is configured to rotate by 180 degrees in a second rotational direction, which is orthogonal to the first rotational direction, from the intermediate position, in which the first seat attachment portions are spaced apart from the table attachment portions, to the storage position, in which the first seat attachment portions are disposed adjacent the table attachment portions and the bottom surface of the first seat faces the bottom surface of the tabletop.

2. The collapsible picnic table of claim 1 further comprising:

a second seat having a top surface and a bottom surface, the second seat disposed on an opposite side of the tabletop from the first seat;

a pair of spaced apart second seat supports that are operable to move between the use position, the intermediate position, and the storage position, each second seat support having:

second seat attachment portions that are pivotally attached to the bottom surface of the second seat and configured to rotate in the first rotational direction in conjunction with the table attachment portions between the use position, in which the second seat supports extend downward from the bottom surface of the second seat, and the intermediate position, in which the second seat supports are disposed adjacent the bottom surface of the second seat; and second seat foot portions spaced apart from the second seat attachment portions, the second seat foot portions operable to contact the ground surface when the second seat supports are in the use position, the second seat foot portions disposed adjacent the bottom surface of the second seat when the second seat supports are in the storage position;

wherein each second seat foot portion is pivotally attached to a corresponding one of the table foot portions and is configured to rotate by 180 degrees in the second rotational direction from the intermediate position, in which the second seat attachment portions are spaced apart from the table attachment portions, to the storage position, in which the second seat attachment portions are disposed adjacent the table attachment portions and the bottom surface of the second seat faces the bottom surface of the tabletop.

3. The collapsible picnic table of claim 1 wherein each first seat support comprises:

a length-adjustable shaft for raising and lowering the first seat; and a latch for selectively securing the shaft in either a first or second vertical position.

4. The collapsible picnic table of claim 3, wherein the length adjustable shaft comprises a first shaft member telescopically positioned within a second shaft member, and wherein the latch comprises a spring-biased detent disposed on the first shaft member configured to selectively engage each one of at least two openings disposed in the second shaft member.

5. The collapsible picnic table of claim 3 wherein the top surface of the first seat is substantially co-planar with the top surface of the tabletop when the shaft is secured in the first vertical position.

6. The collapsible picnic table of claim 1 wherein each of the first and second table supports is X-shaped.

7. The collapsible picnic table of claim 1 further comprising opposing first and second side rails attached to the bottom surface of the tabletop, wherein each of the first and second table supports is pivotally attached between the first and second side rails.

8. The collapsible picnic table of claim 7 further comprising end supports fixedly attached between the first and second side rails and disposed proximate opposing ends of the tabletop, wherein the table attachment portions of each of the first and second table supports are pivotally attached to a corresponding one of the end supports.

9. The collapsible picnic table of claim 7 further comprising a center support fixedly attached between and perpendicular to the first and second side rails.

10. The collapsible picnic table of claim 9 wherein the center support comprises:

a first center support member having a first outer end that is attached to the first side rail at a position that is laterally offset from a center of the tabletop in a third direction; and a second center support member having a second outer end that is attached to the second side rail at a position that is laterally offset from the center of the tabletop in a fourth direction that is opposite the third direction, wherein the first center support member includes a first inner end that is joined to the second center support member at a position that is laterally offset in the fourth direction from the center of the tabletop, wherein the second center support member includes a second inner end that is joined to the first center support member at a position that is laterally offset in the third direction from the center of the tabletop, thereby forming an opening between the first and second inner ends of the first and second center support members.

11. The collapsible picnic table of claim 10 further comprising an aperture in the tabletop that aligns with the opening formed by the first and second inner ends of the first and second center support members.

12. The collapsible picnic table of claim 10 further comprising:

a first articulated support bracket that pivotally connects the first center support member to the first table support; and a second articulated support bracket that pivotally connects the second center support member to the second table support.

13. The collapsible picnic table of claim 1 further comprising:

pivotal tabletop connections for rotatably connecting the table attachment portions of the first and second table supports to the bottom surface of the tabletop;

pivotal seat connections for connecting the first seat attachment portions of the first seat supports to the bottom surface of the first seat, wherein the pivotal seat connections are configured to rotate in the first rotational direction in conjunction with the pivotal tabletop connections; and pivotal foot connections for connecting the table foot portions of the first and second table supports to the first seat foot portions of the first seat supports, the pivotal foot connections configured to rotate in the second rotational direction.

14. A collapsible picnic table comprising:

a tabletop having a top surface and a bottom surface;

first and second X-shaped table supports that are operable to move between a use position and a storage position, the first and second table supports each having:

table attachment portions that are pivotally attached to the bottom surface of the tabletop and configured to rotate in a first rotational direction between the use position, in which the first and second table supports extend downward from the bottom surface of the tabletop, and the storage position, in which the first and second table supports are disposed adjacent the bottom surface of the tabletop; and table foot portions spaced apart from the table attachment portions, the table foot portions operable to contact a ground surface when the first and second table supports are in the use position, the table foot portions disposed adjacent the bottom surface of the tabletop when the first and second table supports are in the storage position;

a first seat having a top surface and a bottom surface;

a second seat having a top surface and a bottom surface, the second seat disposed on an opposite side of the tabletop from the first seat;

a pair of spaced apart first seat supports that are operable to move between the use position, an intermediate position, and the storage position, each first seat support having:

first seat attachment portions that are pivotally attached to the bottom surface of the first seat and configured to rotate in conjunction with the table attachment portions in the first rotational direction between the use position in which the first seat supports extend downward from the bottom surface of the first seat, and the intermediate position in which the first seat supports are disposed adjacent the bottom surface of the first seat;

first seat foot portions spaced apart from the first seat attachment portions, the first seat foot portions operable to contact the ground surface when the first seat supports are in the use position, the first seat foot portions disposed adjacent the bottom surface of the first seat when the first seat supports are in the intermediate position;

a first length-adjustable shaft for raising and lowering the first seat; and a first latch for selectively securing the first shaft in either a first or second vertical position, wherein the top surface of the first seat is substantially co-planar with the top surface of the tabletop when the first shaft is secured in the first vertical position; and a pair of spaced apart second seat supports that are operable to move between the use position, the intermediate position, and the storage position, each second seat support having:

second seat attachment portions that are pivotally attached to the bottom surface of the second seat and configured to rotate in the first rotational direction in conjunction with the table attachment portions between the use position, in which the second seat supports extend downward from the bottom surface of the second seat, and the intermediate position, in which the second seat supports are disposed adjacent the bottom surface of the second seat;

second seat foot portions spaced apart from the second seat attachment portions, the second seat foot portions operable to contact the ground surface when the second seat supports are in the use position, the second seat foot portions disposed adjacent the bottom surface of the second seat when the second seat supports are in the storage position;

a second length-adjustable shaft for raising and lowering the second seat; and a second latch for selectively securing the second shaft in either a first or second vertical position, wherein the top surface of the second seat is substantially co-planar with the top surface of the tabletop when the second shaft is secured in the first vertical position;

pivotal tabletop connections for rotatably connecting the table attachment portions of the first and second table supports to the bottom surface of the tabletop;

pivotal seat connections for connecting the first seat attachment portions of the first seat supports to the bottom surface of the first seat, and for connecting the second seat attachment portions of the second seat supports to the bottom surface of the second seat, wherein the pivotal seat connections are configured to rotate in the first rotational direction in conjunction with the pivotal tabletop connections; and pivotal foot connections for connecting the table foot portions of the first and second table supports to the first seat foot portions of the first seat supports and to the second seat foot portions of the second seat supports, the pivotal foot connections configured to rotate by 180 degrees in a second rotational direction, which is orthogonal to the first rotational direction, from the intermediate position, in which the first seat attachment portions are spaced apart from the table attachment portions, to the storage position, in which the first seat attachment portions are disposed adjacent the table attachment portions and the bottom surface of the first seat faces the bottom surface of the tabletop.

* * * * *